US006761339B2

(12) United States Patent
Minami

(10) Patent No.: US 6,761,339 B2
(45) Date of Patent: Jul. 13, 2004

(54) LEG PART FOR A BARBER OR BEAUTY CHAIR

(75) Inventor: Nobuyuki Minami, Osaka (JP)

(73) Assignee: Oohiro Works Ltd. (JP)

( * ) Notice: Subject to any disclaimer, the term of this patent is extended or adjusted under 35 U.S.C. 154(b) by 546 days.

(21) Appl. No.: 09/832,026

(22) Filed: Apr. 10, 2001

(65) Prior Publication Data

US 2002/0060490 A1 May 23, 2002

(30) Foreign Application Priority Data

Apr. 17, 2000 (JP) ..... 2000-002471

(51) Int. Cl.[7] ..... F16M 11/00; A47C 1/032
(52) U.S. Cl. ..... 248/161; 297/344.19; 248/404
(58) Field of Search ..... 297/344.19; 248/161, 248/404, 631, 188.5

(56) References Cited

U.S. PATENT DOCUMENTS 1,999,848 A * 4/1935 Ries ..... 297/344.19
2,609,862 A * 9/1952 Pratt ..... 297/344.19 X
3,891,270 A * 6/1975 Crossman et al. ..... 297/344.19

FOREIGN PATENT DOCUMENTS

DE 2655312 A1 12/1976
TW 283908 8/1996

* cited by examiner

*Primary Examiner*—Anthony D. Barfield
(74) *Attorney, Agent, or Firm*—Wall Marjama & Bilinski LLP

(57) ABSTRACT

According to a conventional hydraulic-pump-type barber or beauty chair having legs which spread out, radiately and in parallel to a floor surface, from the lower part of a pump, a seat part itself is large and heavy, which results in a high center of gravity. Thus, the chair can quite possibly turn over while it is moved. Further, the legs are arranged at the lower position on the floor surface and are arranged in parallel to the floor surface, resulting in a difficult cleaning under the legs. The present invention is provided with a ring-shaped bracket for fixing the legs with sandwiching the upper part of the hydraulic pump, the upper bracket, and the cylinder part, one another, thereby realizing a design, wherein the legs are radiately arranged therefrom.

1 Claim, 9 Drawing Sheets

LEG PART FOR A BARBER OR BEAUTY CHAIR

FIELD OF THE INVENTION

The present invention relates to a leg part for a barber or beauty chair, in which one end of each leg can be placed to upper part of a pump body.

BACKGROUND OF THE INVENTION

Conventionally, according to a hydraulic-pump-type barber or chair employed in a barber shop or a beauty salon, when legs are placed, the legs are tightened to a lower bracket part of a body with directing from the lower part to the upper part by a bolt-shaped fixed shaft, to fix the legs to the pump body as illustrated in FIG. 9. As illustrated in FIG. 8, the legs are arranged from the lower part of the pump, which results in a spread-out state.

According to conventional hydraulic-pump-type barber or beauty chairs employed in a barber shop or a beauty salon, most of them have legs which spread out, radiately and almost in parallel to a floor surface, from the lower part of the pump, which results in that the design is similar to each other. Further, according to a barber or beauty chair, since a seat part itself is typically large and heavy, a center of gravity is located in a high position. Thus, according to conventional legs in a downwardly-spread-out state, the chair can quite possibly turn over while the chair is moved. Further, the legs are arranged almost in parallel to the floor surface and also are arranged at a position in a close-spaced relationship to the floor surface, whereby it is difficult to clean under the leg part.

SUMMARY OF THE INVENTION

To solve the above problems, according to a first aspect of the present invention, a leg part for a barber or beauty chair comprises a pump body having a hydraulic pump mechanism, legs placed at the upper part of the pump body, a crank for driving the hydraulic pump, and a ram shaft to be a column which moves upwardly and downwardly by a force of the hydraulic pump, said leg part comprising: said pump body, the side face of which is covered by a cylinder part, the bottom of which is covered by a lower bracket, and the upper part of which is covered by an upper bracket, and which has a ring-shaped bracket which is fixed with sandwiched between the upper bracket and the cylinder part to the upper part circumferential portion of the cylinder part; a fixed shaft passing downwardly through an opening provided in the upper bracket, to be screwed into the lower bracket, thereby fixing the pump body with sandwiching the upper bracket, the lower bracket, the ring-shaped bracket, and the cylinder part, one another; said crank for driving the hydraulic pump by a rocking motion in the upward and downward directions at one end of the crank placed at the upper bracket on a fulcrum of the other end; said ram shaft, one end of which is placed within the pump body, and which moves upwardly and downwardly in the direction perpendicular to a floor surface by a force of the hydraulic pump; and plural legs, one end of each leg being placed at the outer circumferential portion of the ring-shaped bracket,- and the other end of each leg touching the floor surface.

According to this structure, it is possible to arrange the legs from the upper part of the pump body, which enables to allow large latitude in the conventionally standardized design. Further, the legs are arranged from a position near the center of the gravity, which enables to obtain a structure, wherein the chair is hard to be turned over. Further, a space from the floor surface to the legs is widely open, thereby easily cleaning under the leg part.

DETAILED DESCRIPTION OF THE PREFERRED EMBODIMENTS

Embodiment 1

Hereinafter, a first embodiment of an invention according to claim 1 of the present invention will be described with referring to FIGS. 1 to 7.

Figure 1:
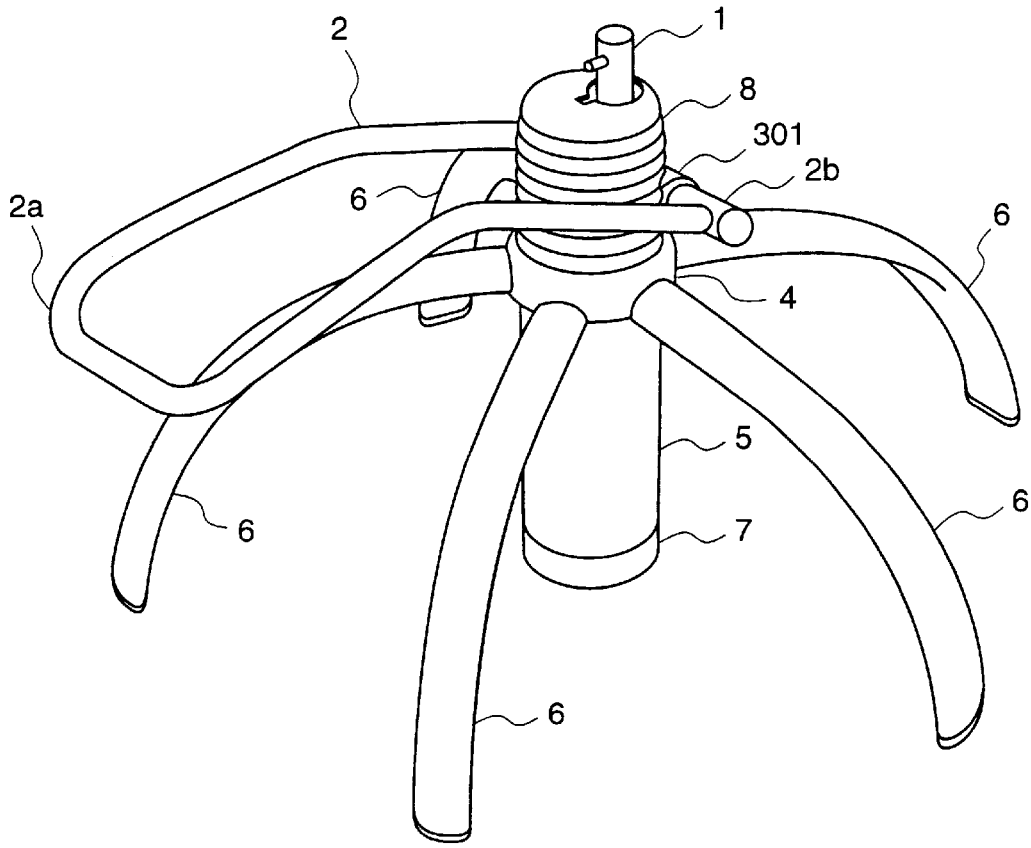
FIG. 1 is a perspective view 1 illustrating a leg part for a barber or beauty chair according to the present invention.
Figure 2:
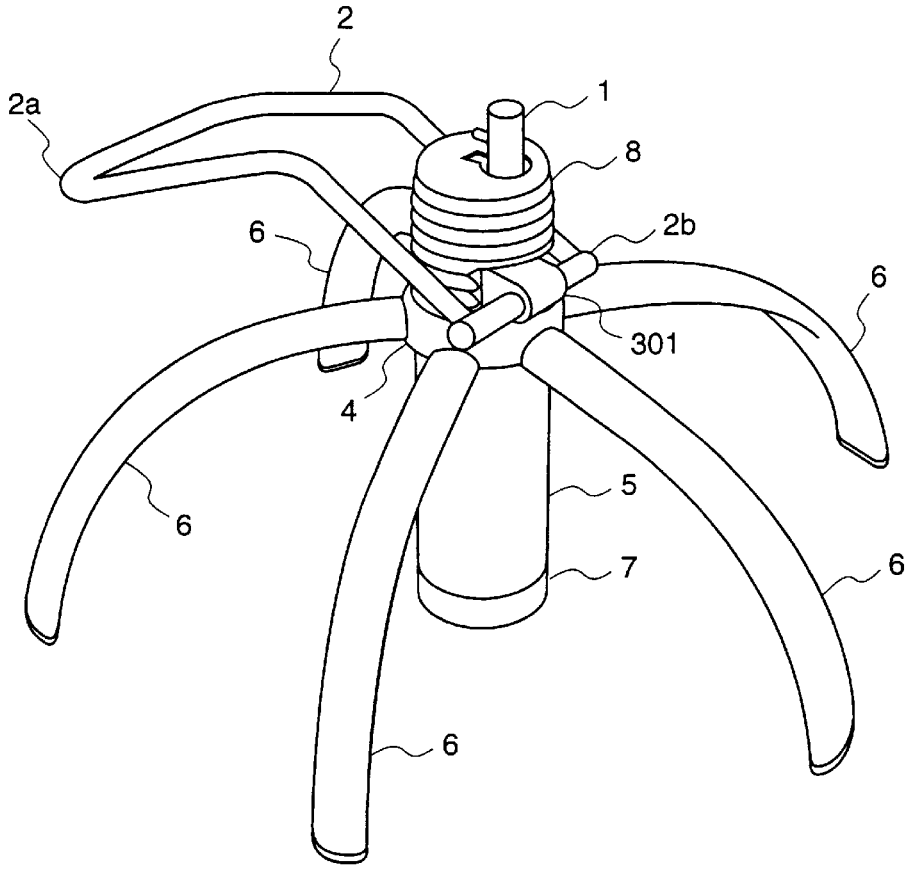
FIG. 2 is a perspective view 2 illustrating a leg part for a barber or beauty chair according to the present invention.
Figure 3:
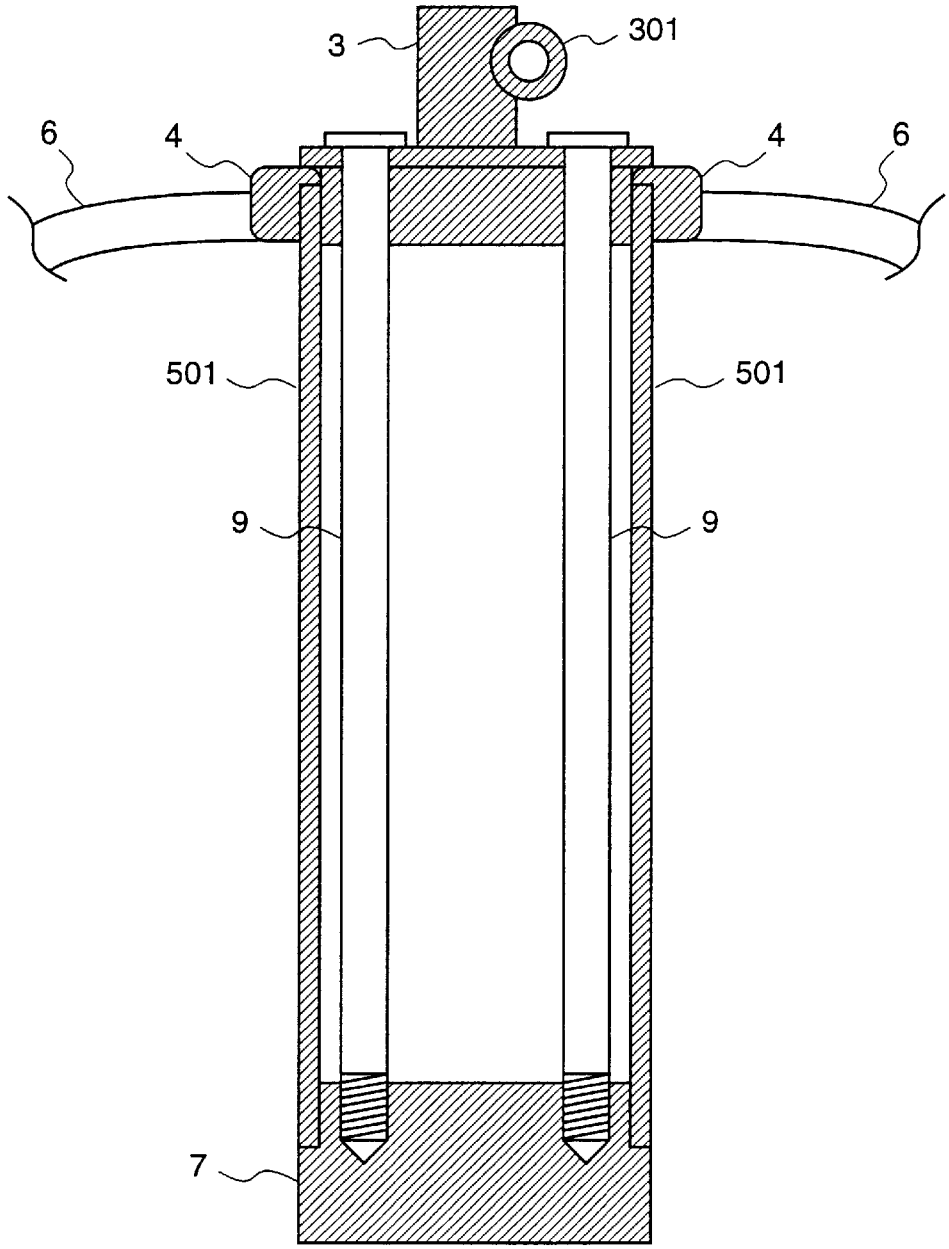
FIG. 3 is a schematic view illustrating a cross section of the upper part of a pump body.

In FIGS. 1, 2, and 3, reference numeral 5 designates a cylindrical pump body. Numeral 1 designates a ram shaft, one end of which is arranged within the pump body, and the other end of which is connected to a not-shown seat part, and which moves upwardly and downwardly by a force of the pump. Numeral 2 designates a crank for applying a force to the pump by a rocking motion. Numeral 301 designates a crank support part for connecting the crank 2 placed at the upper bracket 3 on a rock-able condition, the upper bracket 3 which is connected to the pump body at the upper part, to construct the upper part of the pump. Numeral 8 designates a piston cover for protecting the top part of the pump body. Numeral 4 designates a ring-shaped bracket fixed with sandwiched between the upper part circumferential portion of the pump body 5 and the upper bracket 3 by bolts as illustrated in FIG. 3. Numeral 6 designates five legs, one end of each leg being fastened to the ring-shaped bracket 4, to spread out radiately in the outward direction, and the other end of each leg contacting with the floor surface, whereby holding the entire barber or beauty chair. Numeral 7 designates a lower bracket, which is connected to the bottom part of the pump body 5, to construct the bottom part of the pump body.

Figure 4:
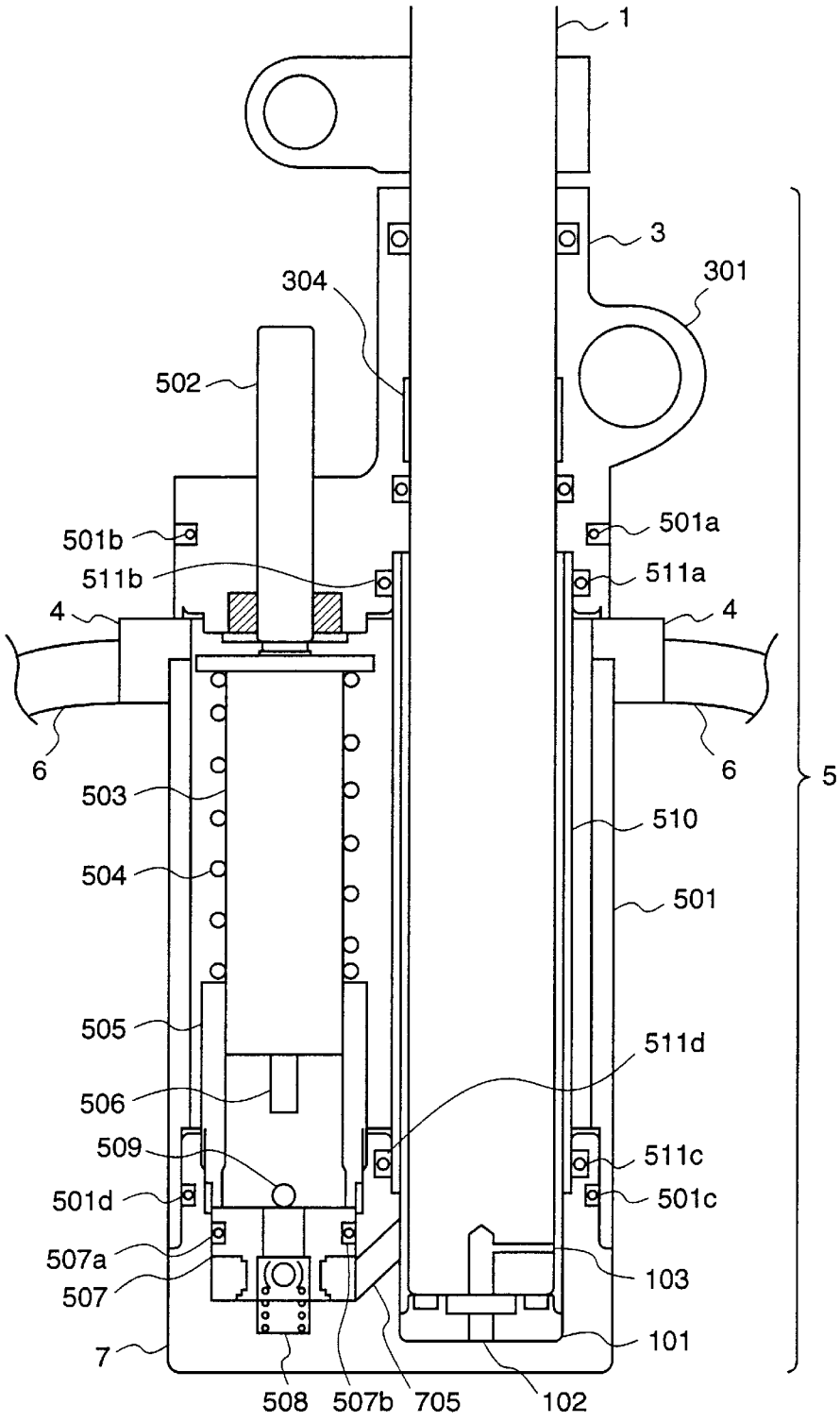
FIG. 4 is a sectional side view illustrating a pump body.
Figure 5:
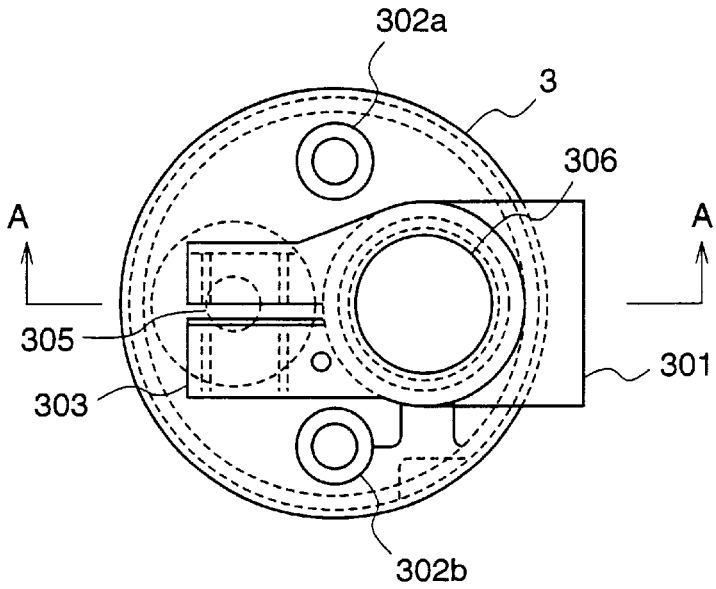
FIGS. 5(*a*) and (*b*) are a top view and a side elevation view illustrating an upper bracket respectively.
Figure 5:
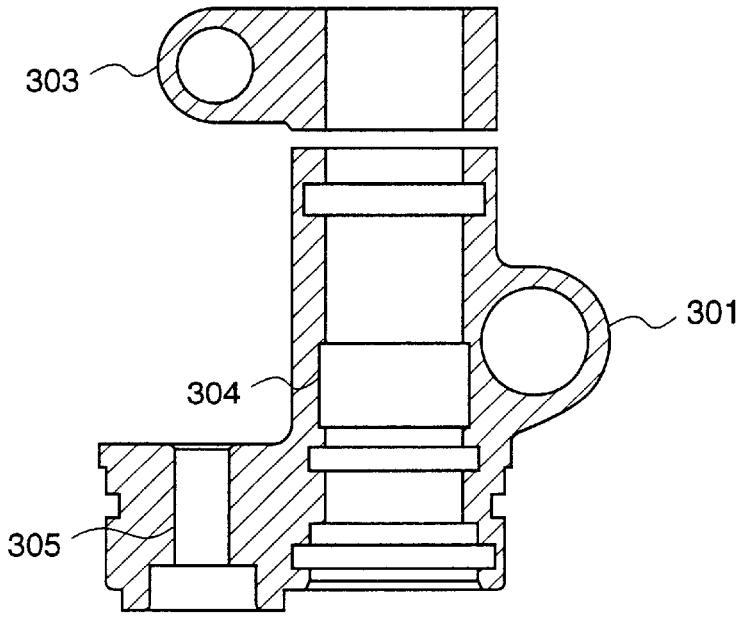
Figure 6:
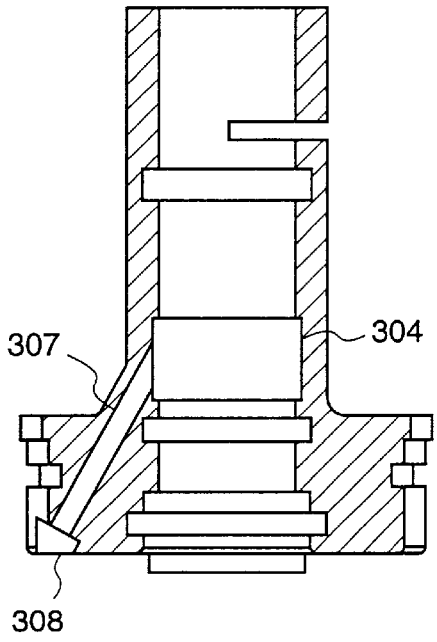
FIGS. 6(*a*) and (*b*) are a cross sectional view and a side elevation view illustrating an upper bracket, respectively.
Figure 6:
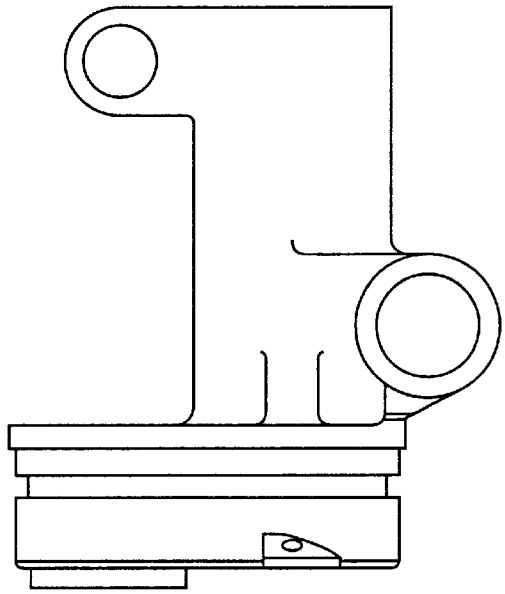
Figure 7:
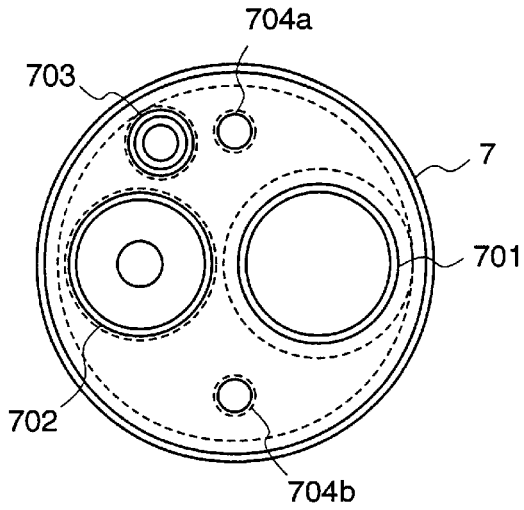
FIGS. 7(*a*), (*b*), (*c*), and (*d*) are a top view, a side elevation view, a cross sectional view illustrating a lower bracket, and a side elevation view illustrating an oil suction part, respectively.
Figure 7:
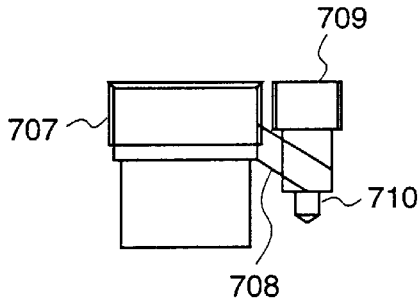
Figure 7:
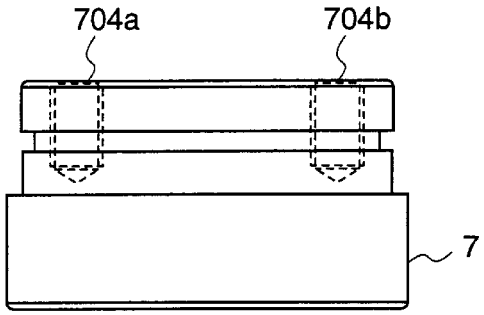
Figure 7:
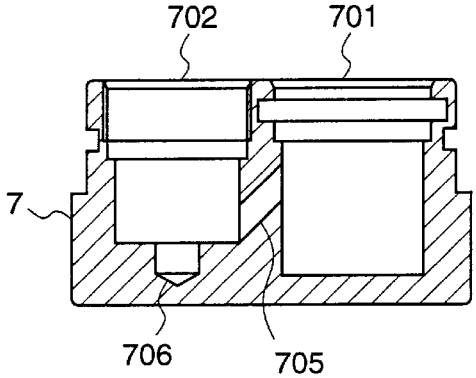
Figure 8:
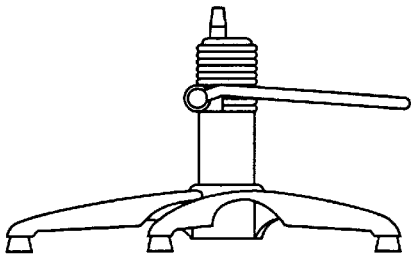
Prior Art Fig.8 (a)
FIGS. 8(*a*), (*b*), (*c*), and (*d*) are side elevation views illustrating a leg part according to a prior art barber or beauty chair.
Figure 8:
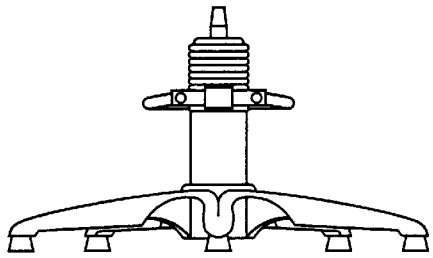
Figure 8:
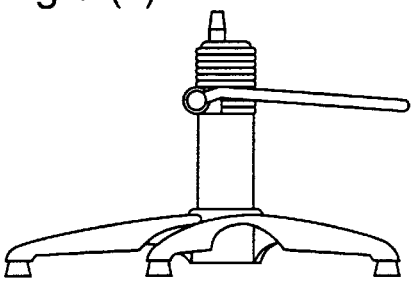
Figure 8:
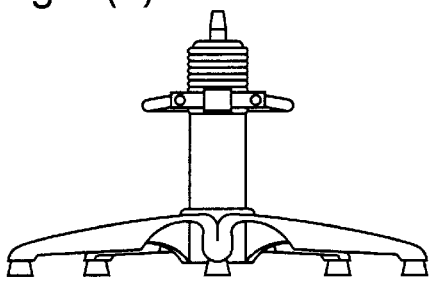
Figure 9:
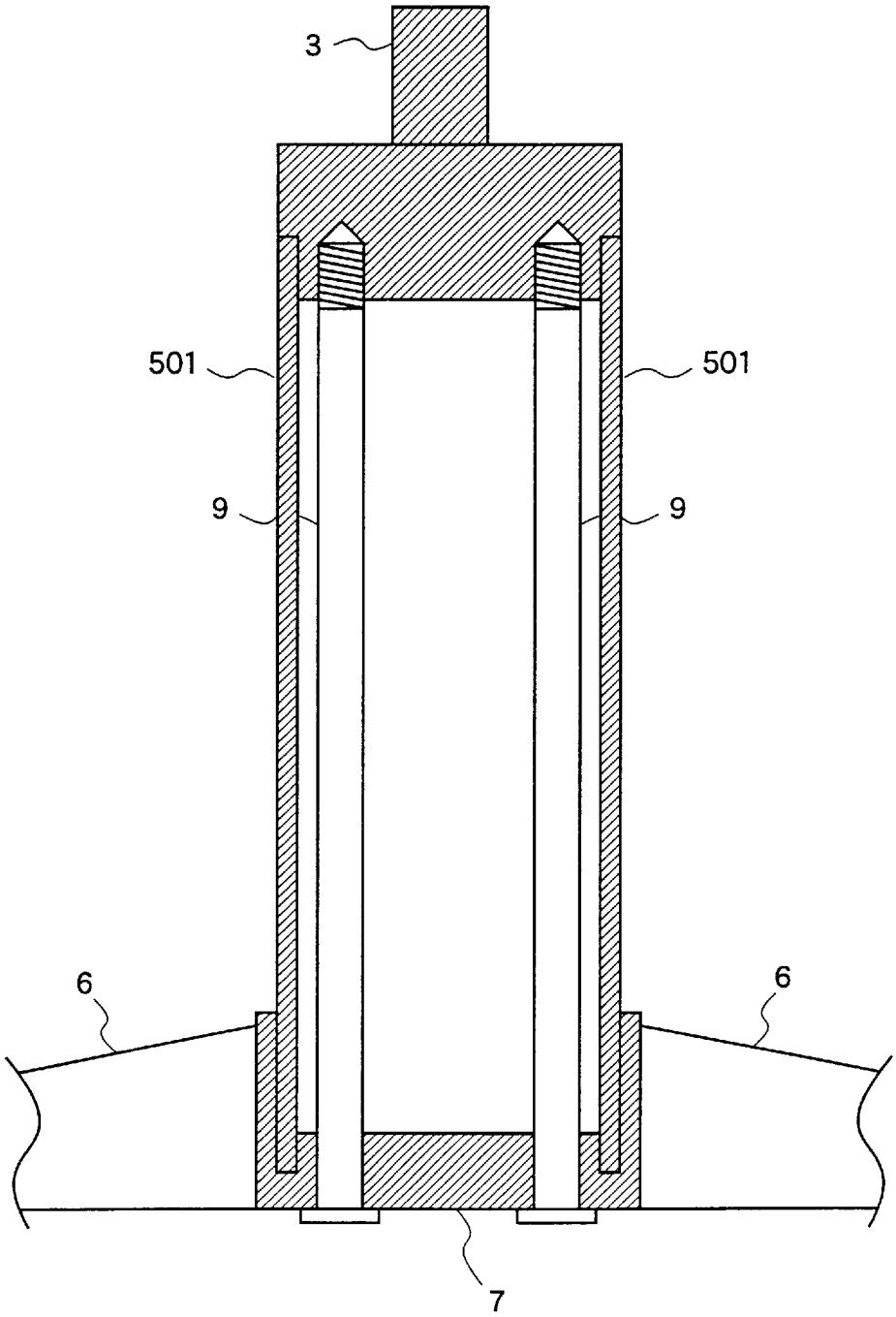
Fig.9 Prior Art
FIG. 9 is a cross section view illustrating a leg part according to a prior art barber or beauty chair.

As shown in FIG. 4, the ram shaft 1 has a rubber bottom 101 at one end thereof, a ram shaft vertical oil path 102 passing the rubber bottom through the center of the bottom part, and a ram shaft horizontal oil path 103 from the side to the ram shaft vertical oil path 102. The upper bracket 3, as shown in FIGS. 5 and 6, has the crank support part, upper bracket junction parts 302*a* and 302*b* for fixing the upper bracket by the bolts, an annular concave recess 304 for exhausting hydraulic oil, which is overly injected by a pressurization, an oil exhausting path 307, an oil exhausting opening 308, a piston rod opening 305, through which the piston rod passes upwardly and downwardly, and a ram shaft opening 306, through which the ram shaft 1 passes upwardly and downwardly. Further, the upper bracket junction parts 302*a* and 302*b* are provided to pass a fixed shaft 9 for connecting to the pump body. The lower bracket 7 has a ram shaft bottom opening 701 which touches a bottom part of the rubber bottom 101 provided at one end of the ram shaft 1, a piston bottom opening 702, into which a valve receiver 707 is fitted and at the bottom of which a piston valve part 706 employing a steel ball and a spring is provided, and further an oil suction opening 703 having an oil suction orifice 709, at the bottom of which an oil suction valve 710 for flowing hydraulic oil only in one direction is provided, and wherein the valve receiver 707 and the oil suction orifice 709 are connected to each other by an oil suction path 708, as illustrated in FIG. 7. Further, lower bracket junction parts 704*a* and 704*b* for connecting by the fixed shaft 9 are provided. Further, as illustrated in FIG. 3, the fixed shaft 9 passes inside the pump body from the downward to the upward with passing the upper bracket through the upper bracket junction parts 302*a* and 302*b*, and which is screwed into the lower bracket junction part like a bolt, whereby the upper bracket, the ring-shaped bracket, a cylinder part, and the lower bracket are connected and fixed to one another.

A structure of the pump body 5 will be described with referring to FIG. 4. The pump body 5, the side of which is covered by a cylinder part 501, which is connected to the upper bracket 3 with covering the top part by cylinder part junction parts 501*a* and 501*b*, and which is connected to the lower bracket 7 with covering the bottom part by cylinder part junction parts 501*c* and 501*d*. The ram shaft 1 passes through the ram shaft opening 306 provided in the upper bracket, and the rubber bottom provided at one end of the ram shaft 1 reaches the ram shaft bottom opening provided in the lower bracket. A joint pipe 510 is provided with covering the side of the ram shaft from the upper bracket to the lower bracket, one end of which is connected to the upper bracket 3 by joint pipe junction parts 511*a* and 511*b*, and the other end of which is connected to the lower bracket by joint pipe junction parts 511*c* and 511*d*. A piston rod 502 is provided with passing the upper bracket through a piston rod opening 305 provided in the upper bracket 3. A stud valve 503 is provided at one end of the piston rod 502 within the pump body 5. Further, a piston projection part 506 is provided at the center of the bottom face of the stud valve. A rod boss 505 is provided with covering the side of the stud valve 503 at the lower part of the stud valve 503, and a piston spring 504 is provided around the stud valve from the top end of the rod boss to the top end of the stud valve, whereby pushing up the stud valve so that the piston is usually placed at the highest place. The rod boss 505, the lower part of which is fitted into the valve receiver 707, and the valve receiver 707 is fitted into the piston bottom opening 702 provided in the lower bracket 7, and a valve 507 is provided at the lower inside of the valve receiver 707. The valve 507 is connected to the lower bracket by the valve junction parts 507*a* and 507*b*. The valve 507 has an opening at the center, which touches the bottom part of the piston bottom opening 702, and a pressurized oil valve 508 employing a steel ball and a spring in the opening. The valve 507 is usually in the closed condition. The oil suction orifice 709 is fitted into the oil suction valve 703. The oil suction valve 710 is provided at the bottom part of the oil suction orifice 709. An oil suction opening 509 is provided at the side face of the rod boss 505 of the upper part of the valve 507, and which is connected to the oil suction path. Further, the pump body 5 is filled with hydraulic oil in the space.

Next, an operation of the leg part for a barber or beauty chair according to the present embodiment 1 is described.

Usually, the crank of the leg part for a barber or beauty chair is hold at the almost horizontal position as illustrated in FIG. 1. The piston rod 502 and the stud valve 503 are hold at the highest position as illustrated in FIG. 4. Further, with reference to the ram shaft, the rubber bottom 101 of which is placed at the lowest position, which touches the ram shaft bottom opening 701 provided in the lower bracket 7.

In this state, one end 2a of the crank is stamped down, which results in that the crank 2 is obliquely lowered on a fulcrum of the crank support part 301, whereby pushing the piston rod 502 down by a not-shown crank lever in the piston cover 8. With this pushing down, the ram shaft 1 is pushed up by a predetermined height by a force of a hydraulic pump, whereby a not-shown chair mounted on the upper part of the ram shaft I is pushed up. Subsequently, the crank 2 is returned to the original horizontal position, which results in that the piston rod 502 is returned to the original highest position, and that the ram shaft is maintained at the pushed up position by a predetermined height.

The above operations are repeated, whereby adjusting the chair connected to the upper part of the ram shaft 1 to a suitable height.

Next, an operation in the pump body 5 will be described.

The piston rod 502 is pushed down by the crank lever, which results in pushing down the stud valve 503, to pressurize hydraulic oil in the rod boss 505. Subsequently, the crank 2 is pushed down, which results in that the piston projection part 506 provided at the lower part of the stud valve 503 pushes down the steel ball in the pressurized oil valve 508, to open the pressurized oil valve 508, whereby the pressurized hydraulic oil passes from the valve 507 through the pressurized oil path 705, to flow into the joint pipe 510. The hydraulic oil flowing into the joint pipe 510 passes from the ram shaft horizontal oil path 103 through the ram shaft vertical oil path 102, to flow into the lower part of the rubber bottom 101. The rubber bottom 101 and the ram shaft 1 are pushed up by the pressure of the hydraulic oil flowing under the rubber bottom 101.

When the force for stamping down the pushed down crank 2 is reduced, the crank 2 is returned to the original horizontal position, whereby the stud valve 503, the piston rod 502, and the piston projecting part 506 are pushed up by the force of the piston spring 504, and the crank 2 is returned to the original position with pushed by the piston rod. Further, when the pressurized oil valve 508 which is pushed down by the piston projection part 506 is returned to the original position, an inverse flowing of the hydraulic oil from the inside of the joint pipe is prevented, whereby the ram shaft 1 is hold at the raised position by a predetermined height. With this rising of the stud valve 503, the hydraulic oil passes from the oil suction orifice 709 through the oil suction valve 710 and oil suction path 708, to flow into the rod boss 505 from the oil suction opening 509 provided at the lower part of the rod boss 505. The oil suction valve 710 is a valve for limiting a flowing of the hydraulic oil to a one-way flowing in a direction of the oil suction orifice 709 side to the oil suction path 708. The above operations are repeated, thereby to push the ram shaft to a suitable height.

Further, when the ram shaft 1 rises until the ram shaft horizontal oil path 103 reaches the annular concave recess 304, the hydraulic oil in the joint pipe 501 flows into the annular concave recess 304 passing through the ram shaft vertical oil path 102 and the ram shaft horizontal oil path 103, and is exhausted into the pipe body 5 from the oil exhausting opening 308 passing through the oil exhausting path 307, whereby the ram shaft is prevented from rising further.

As described above, according to the leg part for a barber or beauty chair of the embodiment 1, the legs can be arranged at the upper part of the pump body without changing any operations of a conventional barber or beauty chair employing a hydraulic pump, whereby largely extending the conventionally standardized design for the legs. Further, the legs are spaced apart from the floor surface, which results in an easy cleaning under the legs. Further, even when a chair, whose center of gravity is high, is employed, the legs are placed at higher position positions, which results in that the legs are arranged near the center of gravity. Therefore, a danger of a turn-over can be prevented.

What is claimed is:

1. A leg part for a barber or beauty chair having a pump body with a hydraulic pump mechanism, legs extending from the pump body, a crank for driving the hydraulic pump, and a ram shaft which moves upwardly and downwardly by a force of the hydraulic pump, said leg part comprising:

said pump body, the side face of which is covered by a cylindrical part, the bottom of which is covered by a lower bracket, and the upper part of which is covered by an upper bracket, and which has a ring-shaped bracket which is fixed to an upper portion of the cylindrical part;

said crank for driving the hydraulic pump having one end placed at the upper bracket;

said ram shaft, having one end of which is placed within the pump body, and which moves upwardly and downwardly in the direction perpendicular to a floor surface by a force of the hydraulic pump; and plural legs, one end of each leg being placed at the outer circumferential portion of the ring-shaped bracket, and the other end of each leg touching the floor surface.

* * * * *